US005639271A

United States Patent [19]

Balme

[11] Patent Number: 5,639,271

[45] Date of Patent: Jun. 17, 1997

[54] ELECTRICAL CONTACT

[75] Inventor: William H. Balme, Mansfield, Mass.

[73] Assignee: Checon Corporation, Attleboro, Mass.

[21] Appl. No.: 447,386

[22] Filed: May 23, 1995

[51] Int. Cl.[6] ..... H01R 9/24

[52] U.S. Cl. ..... 439/862; 439/886; 29/884; 29/882

[58] Field of Search ..... 439/885, 886, 439/851, 862; 29/874, 877, 878, 882, 884

[56] References Cited

U.S. PATENT DOCUMENTS

| | | | |
|---|---|---|---|
| 4,191,445 | 3/1980 | Deal | 439/886 |
| 5,030,144 | 7/1991 | Seidler | 439/885 |
| 5,152,695 | 10/1992 | Grabbe et al. | 439/885 |

OTHER PUBLICATIONS

Figure design showing contact.

*Primary Examiner*—David L. Pirlot
*Attorney, Agent, or Firm*—Fish & Richardon P.C.

[57] ABSTRACT

An electrical contact has a general flat sheet metal support with a pad portion that is twisted (e.g., by about 90 degrees) out of the plane of the metal support, and a contact body attached to the pad portion. The contact may be made by welding a contact body on a pad portion of the contact support while the contact support is essentially in its original flat state; and using one progressive stamping die to isolate the pad portion, form a twist, and stamp out the contact, so that the pad portion is in a plane that is generally perpendicular to the plane of the contact support.

11 Claims, 1 Drawing Sheet

ELECTRICAL CONTACT

BACKGROUND

This invention relates to electrical contacts.

Switches and relays, for example, may include electrical contacts to which connection is made and broken by contact bars that move back and forth to touch and not touch the respective contacts.

For some components the contact surface lies on a contact body that is welded perpendicularly to the main plane of a contact support. This orients the contact surface parallel to the contact bar.

SUMMARY

In general, in one aspect, the invention features an electrical contact having a generally flat sheet metal support with a pad portion that is twisted (e.g., by about 90 degrees) out of the plane of the metal support, and a contact body attached to the pad portion. In implementations of the invention, the contact body may be welded onto the pad portion. The support includes two bridges supporting the pad portion. The contact body may be attached on the side of the pad portion that faces the aperture, or on the side facing away from the aperture.

In general, in another aspect, the invention features a method of making a contact by welding a contact body on a pad portion of a contact support while the contact support is essentially in its original flat state; and, using one progressive stamping die to isolate the pad portion; form a twist, and stamp out the contact, so that the pad portion is in a plane that is generally perpendicular to the plane of the contact support.

Among its advantages, the invention permits less expensive fabrication of the electrical contact by enabling the welding of the contact body to be done more easily and as part of the step of fabricating the contact support.

Other advantages and features will become apparent from the following description and from the claims.

DESCRIPTION

Figure 1A:
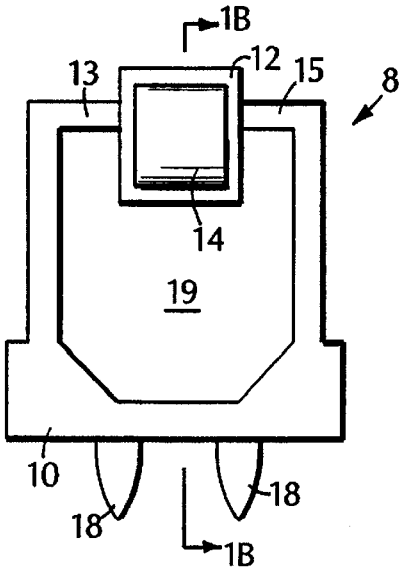
Figure 1B:
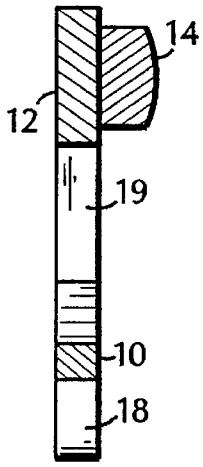

FIGS. 1A and 1B are a front view and a sectional side view (at 1B–1B') of an electrical contact.

Figure 2A:
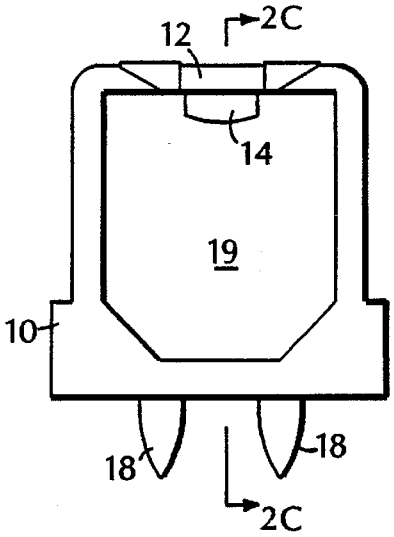
Figure 2B:
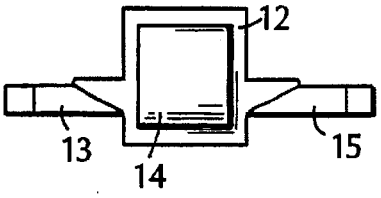
Figure 2C:
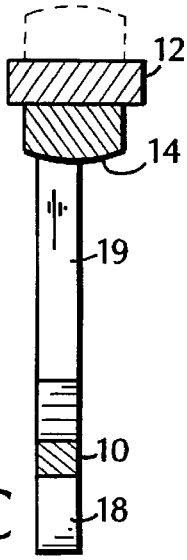

FIGS. 2A, 2B, and 2C are a front view, a top view, and a sectional side view (at 2C–2C') of the contact at a later stage in fabrication.

Referring to FIGS. 1A and 1B, an electrical contact 8 has a flat metal support 10 including a contact pad 12, two mounting tabs 18, and an opening 19. A contact body 14 is welded onto the contact pad 12.

Referring to FIGS. 2A through 2C, after the contact body has been welded onto the contact pad, the pad is twisted relative to the main plane of the support 10 through an angle of about 90 degrees. The twisting is accomplished in a progressive stamping tool. The contact body could be mounted either facing toward the aperture, or facing away form the aperture, as shown in dotted line in FIG. 2C, or two contacts could be mounted, one facing toward the aperture, the other facing away.

In one example, the support 10 is fabricated from C19400 (Brass) alloy with a thickness of 0.032" and the contact body from silver nickel material.

The complete assembly is made by welding a nugget of the contact material to the base metal directly (without high resistance interlayers), followed by isolating the contact pad, forming the twist and then stamping the part out, all in one progressive stamping die. This one step high speed manufacturing process is inexpensive and produces a superior quality interface between contact and support material.

The twist produces a highly compact design of a contact assembly of the kind that requires the contact to be positioned at the end of a terminal and perpendicular to it. This is particularly important as switch designs get smaller and smaller.

Other embodiments are within the scope of the following claims. For example, the contact pad could be twisted to angles of other than 90°.

What is claimed is:

1. An electrical contact comprising:

a generally flat integral sheet metal support including a generally flat pad portion and support portions which support opposite ends of the flat pad portion, the flat pad portion and the support portions together surrounding an aperture in said metal support, said support portions being twisted in the vicinity of the flat pad portion so that the flat pad portion lies out of a plane of the metal support; and a contact body attached to the pad portion.

2. The contact of claim 1, wherein the contact body is welded onto the pad portion.

3. The contact of claim 1, wherein the flat pad portion is supported by two bridges.

4. The contact of claim 1, wherein the metal support comprises brass with a thickness of about 0.032" and the contact body comprises silver nickel.

5. An electrical contact comprising:

a generally flat integral sheet metal support including a generally flat pad portion and support portions which support opposite ends of the flat pad portion, the flat pad portion and the support portions together surrounding an aperture in said metal support, said support portions being twisted in the vicinity of the flat pad portion so that the flat pad portion lies out of a plane of the metal support by an angle of about 90 degrees, and is supported by two bridges, and a contact body welded on a side of the flat pad portion that faces toward or away from the aperture.

6. The contact of claim 3, wherein the metal support comprises brass with a thickness of about 0.032" and the contact body comprises silver nickel.

7. The contact of claim 5, wherein the flat pad portion faces toward the aperture.

8. A method of making an electrical contact comprising:

welding a contact body on a pad portion of a contact support while the contact support is essentially in an original flat state, and using a progressive stamping die to isolate the pad portion, form a twist, and stamp out the contact, so that the pad portion is in a plane that is generally perpendicular to a plane of the contact support.

9. The method of claim 8, wherein the use of the progressive stamping die further comprises forming an aperture in the contact support.

10. The contact of claim 1, wherein the flat pad portion lies out of the plane of the metal support by an angle of about 90 degrees.

11. The contact of claim 10, wherein the flat pad portion projects farther from one side of the metal support than from the other side of the metal support.

* * * * *